US008376782B2

(12) United States Patent
Govekar

(10) Patent No.: US 8,376,782 B2
(45) Date of Patent: Feb. 19, 2013

(54) POWER STRIP WITH INPUT PLUG

(75) Inventor: Craig Govekar, Gurnee, IL (US)

(73) Assignee: Snap-On Incorporated, Kenosha, WI (US)

( * ) Notice: Subject to any disclaimer, the term of this patent is extended or adjusted under 35 U.S.C. 154(b) by 0 days.

(21) Appl. No.: 12/462,183

(22) Filed: Jul. 30, 2009

(65) Prior Publication Data

US 2010/0035479 A1 Feb. 11, 2010

Related U.S. Application Data

(60) Provisional application No. 61/137,393, filed on Jul. 30, 2008.

(51) Int. Cl.
*H01R 33/00* (2006.01)

(52) U.S. Cl. ..... 439/652; 439/502; 439/505

(58) Field of Classification Search ..... 439/652, 439/650, 651, 214, 216, 215, 954; 361/651; 307/64, 66; 174/72 B
See application file for complete search history.

(56) References Cited

U.S. PATENT DOCUMENTS

| | | | | | |
|---|---|---|---|---|---|
| 1,836,822 | A | * | 12/1931 | Sneed | 464/171 |
| 4,081,206 | A | | 3/1978 | Lee | |
| 4,659,161 | A | * | 4/1987 | Holcomb | 439/490 |
| 4,846,697 | A | | 7/1989 | Rodgers | |
| 4,950,178 | A | * | 8/1990 | Harvey et al. | 439/507 |
| 4,954,091 | A | * | 9/1990 | Marble et al. | 439/103 |
| 5,234,360 | A | * | 8/1993 | Kramer, Jr. | 439/505 |
| 5,439,390 | A | * | 8/1995 | Raynor et al. | 439/502 |
| 5,575,685 | A | * | 11/1996 | Ittah et al. | 439/595 |
| 5,579,201 | A | | 11/1996 | Karageozian | |
| 5,582,522 | A | * | 12/1996 | Johnson | 439/214 |
| 5,658,158 | A | * | 8/1997 | Milan | 439/214 |
| 5,700,150 | A | * | 12/1997 | Morin | 439/4 |
| 5,708,554 | A | * | 1/1998 | Liner | 361/104 |
| 5,855,262 | A | * | 1/1999 | Jackson | 191/12.4 |
| D407,372 | S | * | 3/1999 | Starec et al. | D13/139.2 |
| 5,917,151 | A | * | 6/1999 | O'Brien et al. | 174/72 A |
| 5,931,702 | A | * | 8/1999 | Fladung | 439/652 |
| 6,024,588 | A | * | 2/2000 | Hsu et al. | 439/173 |
| 6,045,374 | A | * | 4/2000 | Candeloro | 439/105 |
| 6,045,399 | A | * | 4/2000 | Yu | 439/502 |
| 6,179,665 | B1 | * | 1/2001 | Rossman et al. | 439/654 |
| D448,730 | S | * | 10/2001 | Lee | D13/137.4 |
| 6,341,875 | B1 | * | 1/2002 | Chu | 362/249.06 |
| 6,439,360 | B1 | * | 8/2002 | Miller | 191/12.2 R |
| 6,439,923 | B1 | * | 8/2002 | Kirkendall et al. | 439/502 |
| D467,873 | S | * | 12/2002 | Yu | D13/137.2 |

(Continued)

FOREIGN PATENT DOCUMENTS

| | | |
|---|---|---|
| CN | 201234039 | 9/2009 |
| WO | WO2004/001922 A2 | 12/2003 |

OTHER PUBLICATIONS

International Preliminary Report on Patentability dated Feb. 10, 2011 and Written Opinion, etc., dated Sep. 2, 2009 re PCT/US2009/004389.

(Continued)

*Primary Examiner* — Renee Luebke
*Assistant Examiner* — Harshad Patel
(74) *Attorney, Agent, or Firm* — Seyfarth Shaw LLP

(57) ABSTRACT

A power strip comprising a housing, a plurality of female outlets on at least one surface of the housing, and a recessed connector, such as an IEC connector, on a surface of the housing, is disclosed. The recessed connector is wired within the housing to provide power to the plurality of female outlets. Preferably, the recessed connector is a male plug for connection to a power cord or wire harness.

7 Claims, 6 Drawing Sheets

U.S. PATENT DOCUMENTS

| | | | | |
|---|---|---|---|---|
| D469,064 | S * | 1/2003 | Nieto | D13/137.2 |
| D469,403 | S * | 1/2003 | Nieto | D13/137.2 |
| D470,460 | S * | 2/2003 | Yu | D13/139.8 |
| 6,540,137 | B1 | 4/2003 | Forsythe et al. | |
| 6,540,549 | B2 * | 4/2003 | Rupert | 439/502 |
| 6,607,391 | B2 * | 8/2003 | Mendelson et al. | 439/39 |
| 6,727,477 | B1 * | 4/2004 | Li-Chen | 219/494 |
| 6,755,676 | B2 * | 6/2004 | Milan | 439/214 |
| 6,854,768 | B2 * | 2/2005 | Elder | 285/146.1 |
| 6,962,506 | B1 * | 11/2005 | Krobusek | 439/502 |
| 7,057,108 | B1 * | 6/2006 | Sodemann et al. | 174/71 R |
| 7,311,526 | B2 * | 12/2007 | Rohrbach et al. | 439/39 |
| 7,607,928 | B2 * | 10/2009 | Schriefer et al. | 439/214 |
| 7,625,212 | B2 * | 12/2009 | Du | 439/39 |
| 2002/0189848 | A1 * | 12/2002 | Hawker et al. | 174/149 B |
| 2003/0103304 | A1 | 6/2003 | Rendic | |
| 2004/0087207 | A1 * | 5/2004 | Lerch | 439/502 |
| 2005/0239337 | A1 * | 10/2005 | Shiga | 439/660 |
| 2005/0250375 | A1 * | 11/2005 | Allison | 439/502 |
| 2006/0079121 | A1 * | 4/2006 | Bruno | 439/502 |
| 2007/0259548 | A1 * | 11/2007 | Byrne | 439/215 |
| 2008/0035507 | A1 * | 2/2008 | Collister et al. | 206/349 |

OTHER PUBLICATIONS

UK Search and Examination Report dated Jul. 26 2012 in Applicants' corresponding application No. 1101436.2.

* cited by examiner

POWER STRIP WITH INPUT PLUG

RELATED APPLICATION

This application claims the priority of, and hereby incorporates by reference, provisional application Ser. No. 61/137,393 filed Jul. 30, 2008.

TECHNICAL FIELD OF THE INVENTION

The present device relates to power strips. Particularly, the present device relates to a power strip capable of connection to various sources.

BACKGROUND OF THE INVENTION

Standard commercial power strips are typically comprised of a housing body having a plurality of outlets on a top surface and a power cord extending from an end with a male plug for plugging directly into a power source, such as a wall outlet, and providing power and surge protection to the multiple outlets. The extra outlets allow several devices—for example, a computer, a monitor, and a printer—to be run from a single wall outlet.

However, there are some instances where a power strip would be useful, but the standard extending power cord is not versatile enough for the desired use. For example, a power tool drawer used to provide power to a number of power tool battery charging stations may need a more flexible cord to handle the repeated opening and closing of the drawer. Also, a computer desk may benefit from a fixed mounted power strip with a connector on the back of the desk for providing power to the strip.

Current power strips, which are pre-wired with cords having male plugs have limited usefulness in such applications.

Accordingly, the present invention solves these and other problems of prior power strip devices.

SUMMARY OF THE INVENTION

There is disclosed herein an improved power strip which avoids the disadvantages of prior devices while affording additional structural and operating advantages.

A power strip comprising a housing, a plurality of female outlets on at least one surface of the housing, and a recessed connector, such as an IEC connector, on a surface of the housing, is disclosed. The recessed connector is wired within the housing to provide power to the plurality of female outlets. Preferably, the recessed connector is a male plug for connection to a power cord or wire harness.

Preferably, the power cord which may be used in certain embodiments comprises a connector at one end to couple to the recessed connector and a male plug at another end to connect to a power outlet. Likewise, the wire harness comprises at least one connector for detachable connection to the recessed connector of the housing, and one connector for detachable connection to a power cord.

In an embodiment, the at least one connector for detachable connection to the recessed connector comprises at least two different connectors. Additionally, the wire harness may comprise at least one connector for detachable connection to the recessed connector of the housing, and at least one connector for detachable connection to a power cord.

A power strip assembly is also described. The assembly comprises at least one power strip having a housing, a plurality of female outlets on at least one surface of the housing, and a recessed connector on a surface of the housing, wherein the recessed connector is wired within the housing to provide power to the plurality of female outlets, and a wire harness attachable to the recessed connector.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1A:
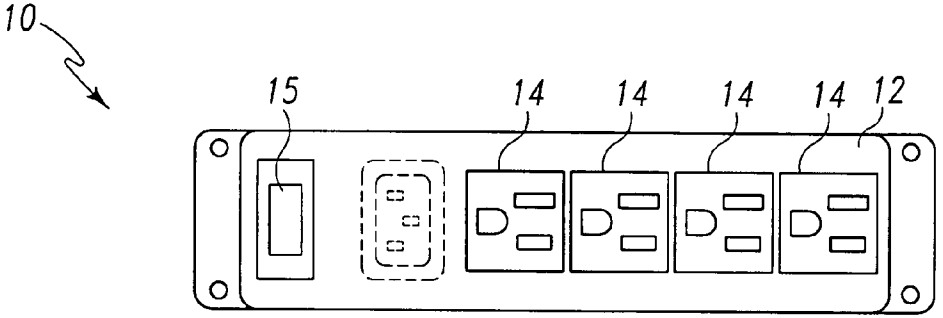
FIGS. 1A-1D are a collection of views of a power strip in accordance with an embodiment of the present invention.
Figure 1B:
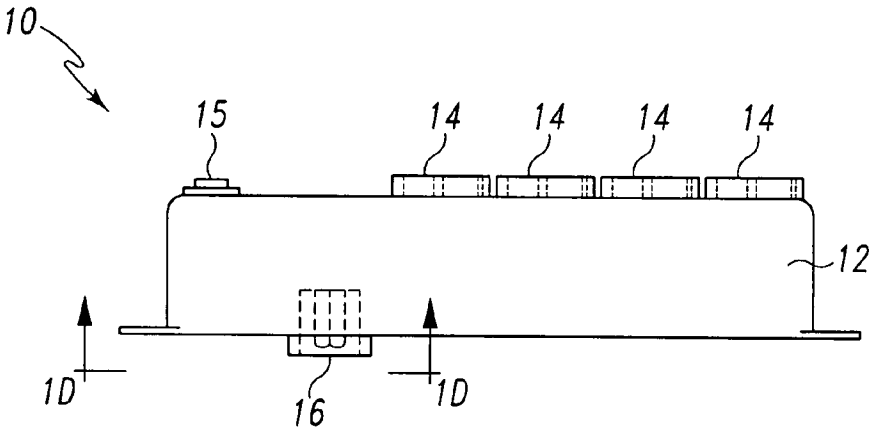
Figure 1C:
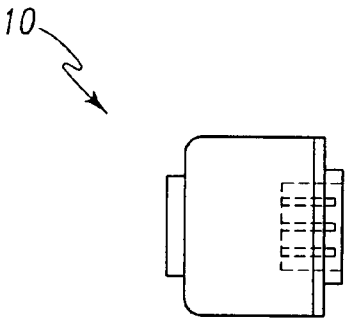
Figure 1D:
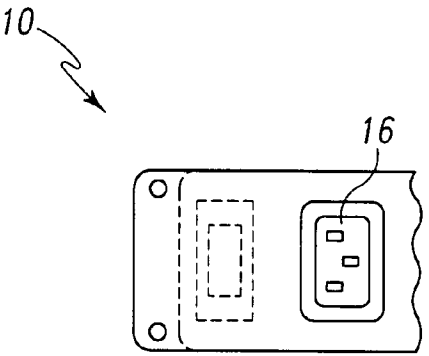

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Referring to FIGS. 1-5, there is illustrated a power strip, generally designated by the numeral 10. The power strip 10 has a housing 12 including several surfaces. The upper surface of the housing 12 preferably includes a series of female power outlets 14 and a power switch 15. On another surface—the bottom surface of the housing is shown though any of the surfaces of the strip 10 may be suitable—a recessed connector 16 is positioned. As noted, the connector 16 may alternatively be placed on a side surface or top surface, as well. The connector 16 is preferably an IEC connector, as such connectors and cords for the same are widely used and readily available. Naturally, other suitable connectors known to those skilled in the art may also be used.

Within the housing 12, wiring is provided to connect each of the female outlets 14 to the connector 16 and the power switch 15, such that power coming into the strip 10 at the connector can be directed to the outlets 14 by turning on the power switch 15. The power can also be discontinued by turning off the power switch 15. Such wiring is well understood by those skilled in the art.

Detachably connected to the connector 16 is a cord 20. Though not shown, a simple power cord having a female connector at one end which mates with the connector 16 of the power strip 10, and a male plug at the other end for directly plugging into a power outlet, may be suitable for some uses. Such a configuration would allow the power strip 10 to be used as a standard power strip.

Figure 2A:
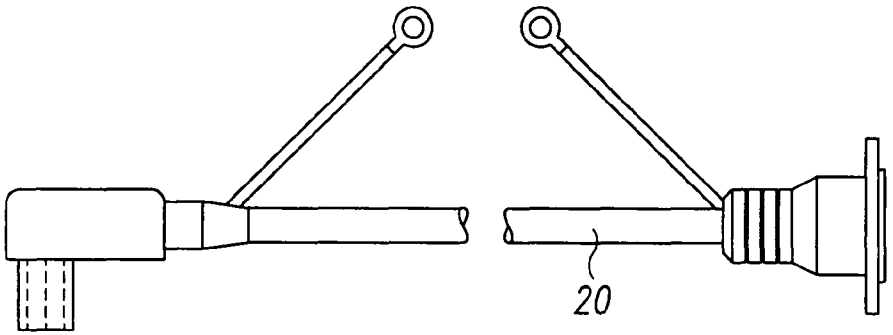
FIGS. 2A-2D are a collection of views of a power cord in accordance with an embodiment of the present invention.
Figure 2C:
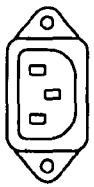
Figure 2B:
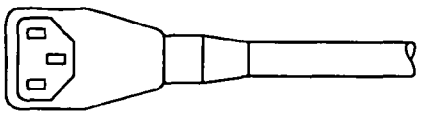
Figure 2D:
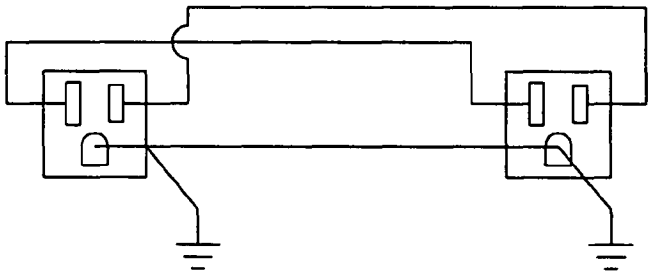

FIGS. 2A-C illustrate a preferred power cord 20 having an angled connector (C13) at one end and a male AC power inlet connector (C16) at the other end. While the C13 and C16 connectors are most preferred, other IEC connectors such as, but not limited to the C14, C15, C17 and C18 connectors are certainly feasible for some applications. The angled connector of power cord 20 connects directly to the connector 16 of the power strip. The AC power inlet connector could be mounted, for example, to the surface of a tool chest, a computer desk, a drafting table, or other such system or device requiring a supply of power. From the AC power inlet connector, a power cable as described above could be connected.

Figure 3A:
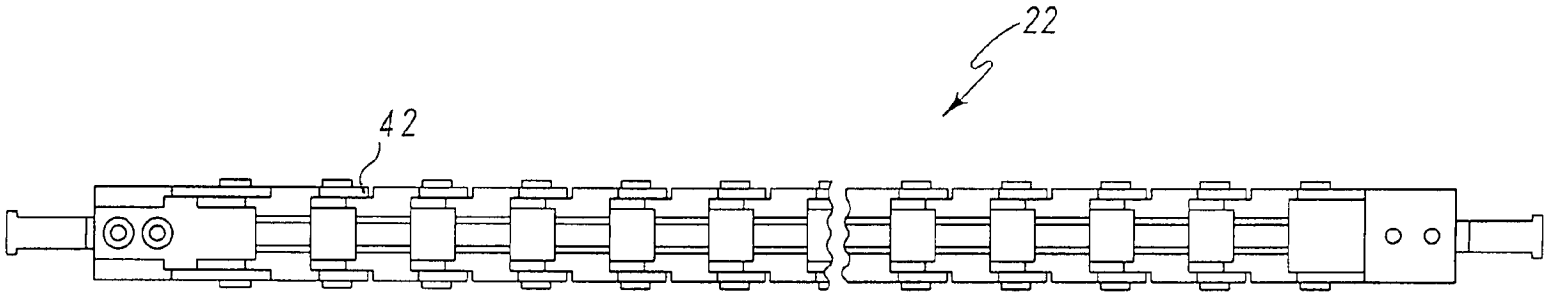
FIGS. 3A and 3B are a collection of views of a flexible cord carrier in accordance with an embodiment of the present invention.
Figure 3B:
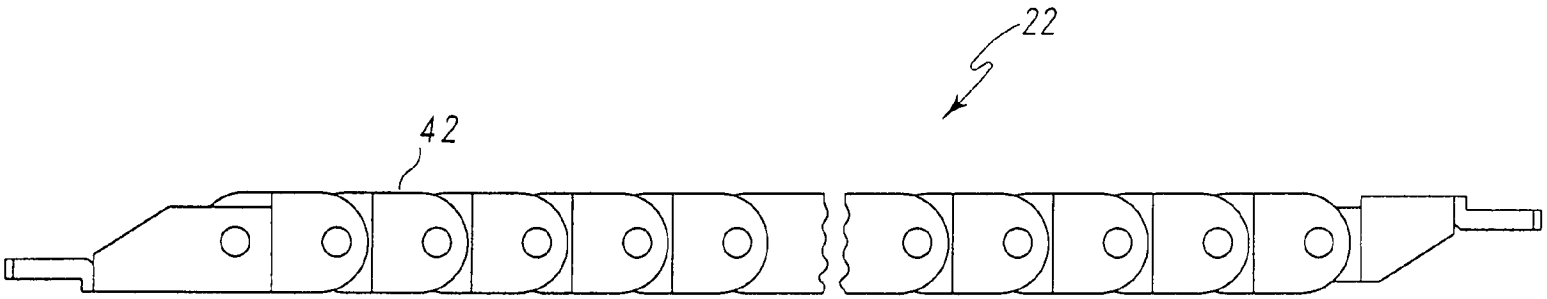

Referring to FIGS. 3A and B and 4A and B, a flexible cord carrier 22 is illustrated as it might be used in a power drawer (not shown). The carrier 22, which is comprised of a series of protective links 42, is used to protect a power cable which undergoes repeated bending and flexing.

Figure 4B:
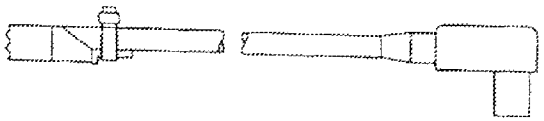
FIGS. 4A and 4B are a collection of views of a possible configuration of a power drawer harness in accordance with an embodiment of the present invention.
Figure 4A:
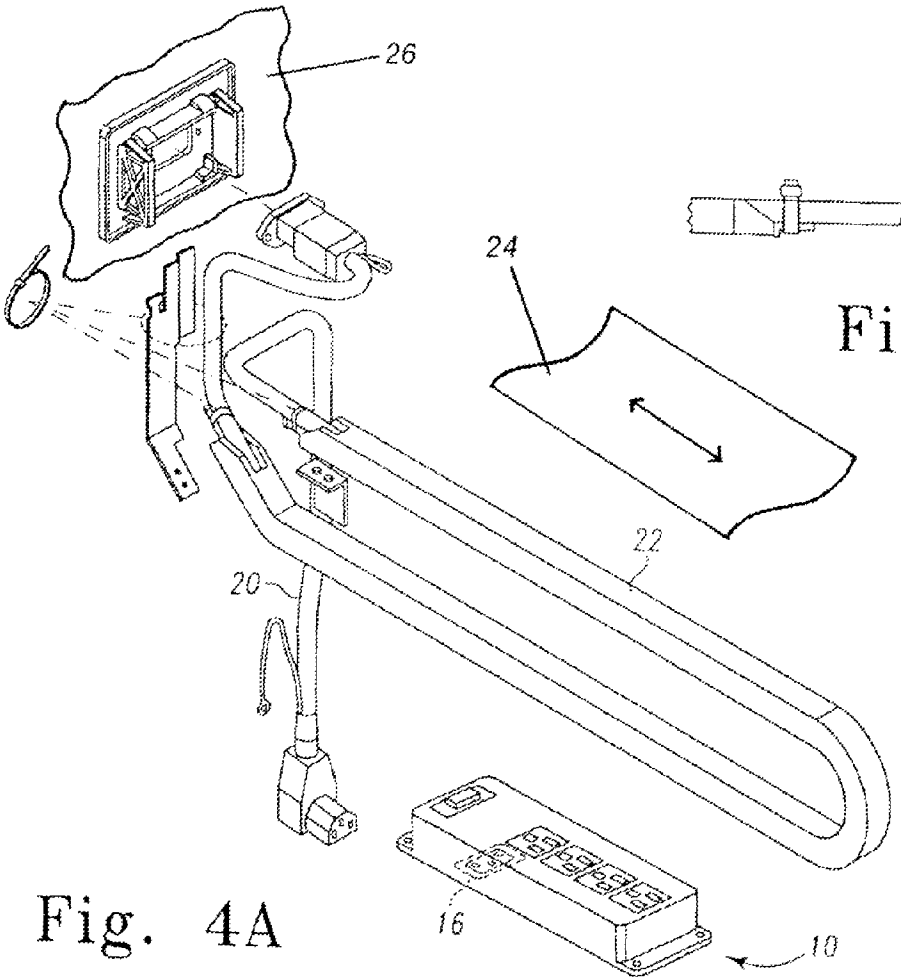

A suitable configuration, shown in FIGS. 4A and 4B, might include the power strip 10 mounted permanently within a tool box drawer 24 to power, for example, several battery chargers. The C13 connector of the power cord 20 would be connected to the connector 16 of the power strip 10 and a section of the cord 20 which is subject to repeated flexing due to the opening and closing of the drawer 24, would be housed within the carrier 22. The AC power inlet end of the cord could then be mounted, as shown, on a back surface 26 of the tool box. Again, a power cord having a standard male plug can be attached from the outside of the tool chest for ultimately bringing AC power to the power strip 10.

Figure 5A:
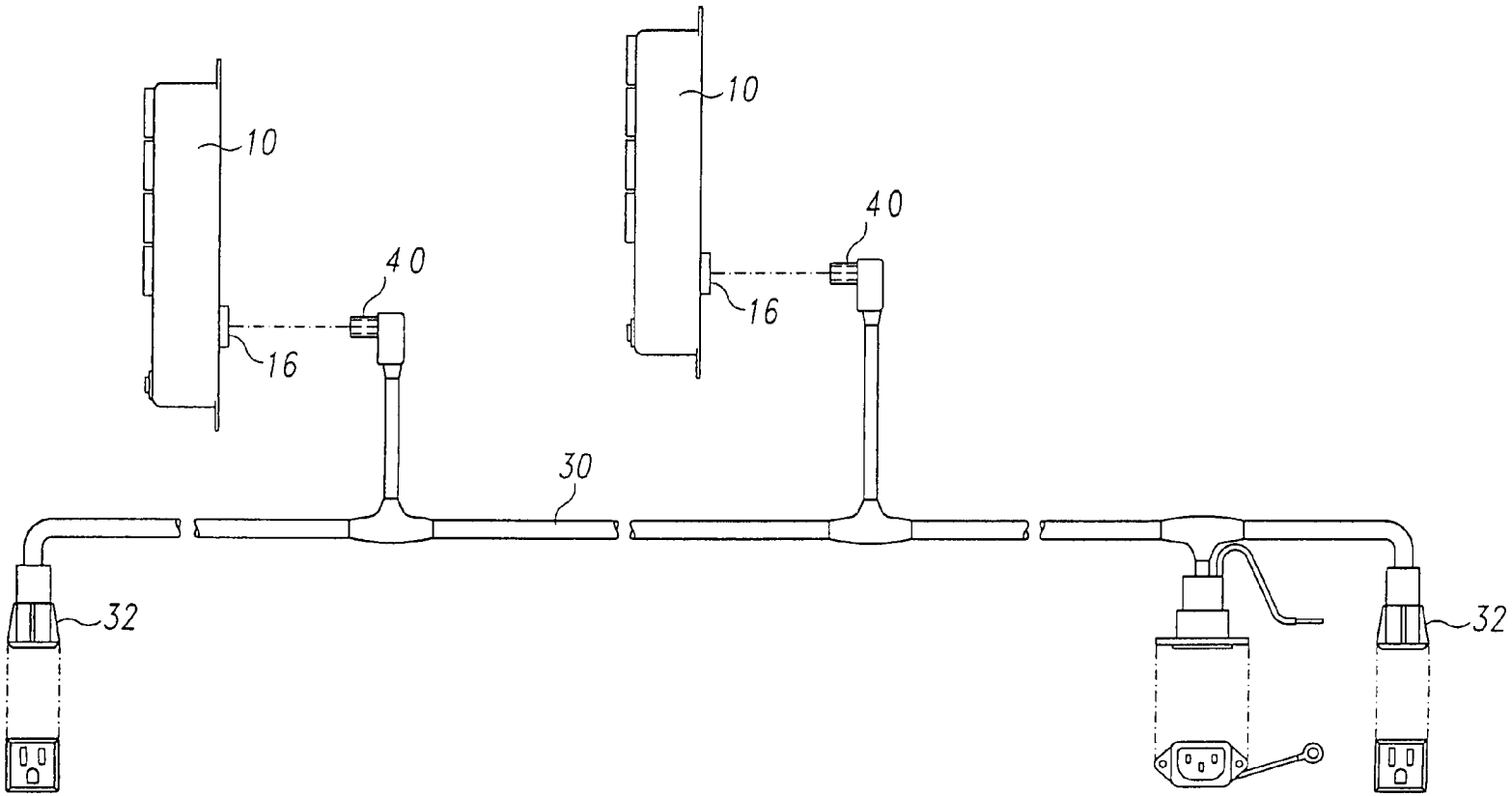
FIG. 5 is a collection of views of a wire harness in accordance with an embodiment of the present invention.
Figure 5B:
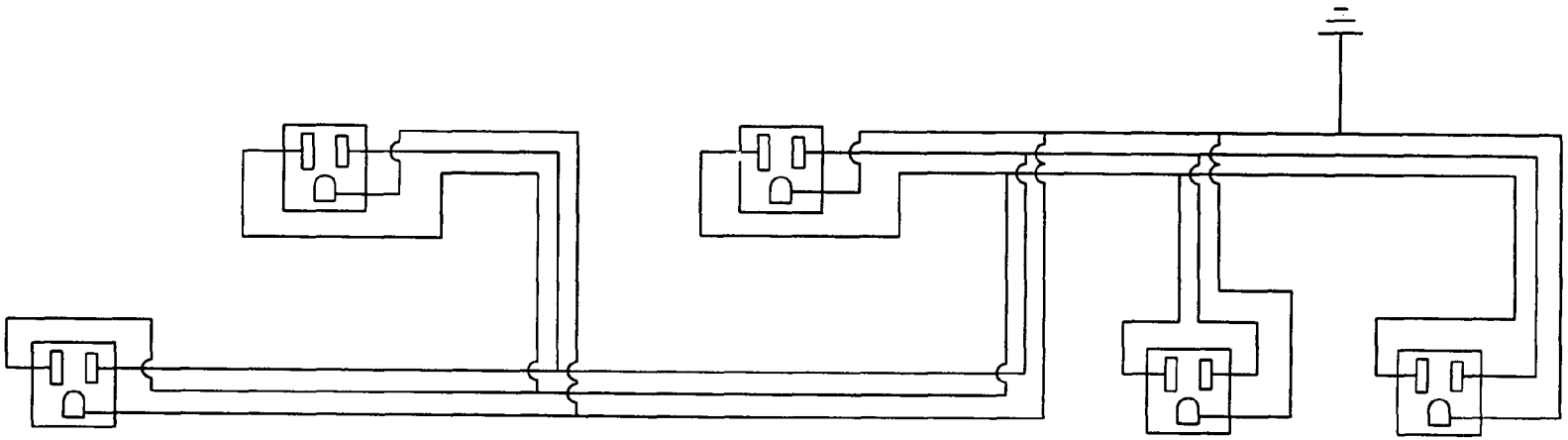

Other possible configurations for power strip 10 include linking several together using a wire harness 30, as illustrated in FIG. 5. For example, where a number of power strips 10 are secured to different locations of a workstation (such as a computer desk, drafting table, tool bench or the like), they may be connected through a wire harness 30 having a plurality of connectors 40. Additional single outlets 32, if desired, may also be provided at locations about the workstation. Ultimately, the power to the outlets of the power strips 10 and the single outlets 32 is provided through the AC power inlet mounted on a surface of the workstation and connected through another power cord to a power source.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An apparatus comprising:

a cable including:

a power inlet end having a surface mountable AC power inlet connector;

a power outlet end having an AC power connector;

a first cable section adjacent to the power inlet end;

a second cable section adjacent to the power outlet end; and a middle cable section between the first cable section and the second cable section;

a second power outlet end having a second AC power connector;

a third cable section extending from at least one of the first cable section and the second cable section to the second power outlet end;

a cable carrier disposed on the middle cable section;

a first ground wire portion extending from the power inlet end;

a second ground wire portion extending from the power outlet end, the first ground wire and the second ground wire portion adapted to be coupled to an electrical ground;

a first power strip including a first surface and a second surface, the first surface having a plurality of female connectors and the second surface having a recess and a male connector provided in the recess, the AC power connector having a female connector adapted to couple to the male connector of the first power strip, thereby providing an electrical connection; and a second power strip wherein the second AC power connector is adapted to couple to the second power strip.

2. The apparatus of claim 1, wherein the cable carrier includes a plurality of protective links.

3. The apparatus of claim 1, wherein the AC power inlet connector is mounted to a surface of a tool box.

4. The apparatus of claim 1, wherein the cable carrier includes a first end fastened proximate to the first cable section, and a second end fastened proximate to the second cable section.

5. The apparatus of claim 4, wherein the first end of the cable carrier is adapted to be coupled to a surface of a tool box.

6. The apparatus of claim 5, wherein the second end of the cable carrier is adapted to be coupled to a drawer of the tool box.

7. The apparatus of claim 1, wherein the first power strip is adapted to be mounted on a surface of a drawer of a tool box.

* * * * *